US007178592B2

(12) United States Patent
Chitty et al.

(10) Patent No.: US 7,178,592 B2
(45) Date of Patent: Feb. 20, 2007

(54) CLOSED LOOP MULTIPHASE UNDERBALANCED DRILLING PROCESS

(75) Inventors: Gregory H. Chitty, Houston, TX (US); Jeffrey Charles Saponja, Calgary (CA); David Graham Hosie, Sugar Land, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 494 days.

(21) Appl. No.: 10/192,784

(22) Filed: Jul. 10, 2002

(65) Prior Publication Data

US 2004/0007131 A1 Jan. 15, 2004

(51) Int. Cl.
*E21B 21/01* (2006.01)
*E21B 21/16* (2006.01)

(52) U.S. Cl. ..... 166/267; 175/66; 175/69; 175/207; 417/313; 417/251; 417/265

(58) Field of Classification Search ..... 175/66, 175/207, 25, 69, 205, 222; 166/267; 417/313, 417/251, 265, 254
See application file for complete search history.

(56) References Cited

U.S. PATENT DOCUMENTS

| | | | | |
|---|---|---|---|---|
| 4,020,642 A | | 5/1977 | Haselden et al. | |
| 4,099,583 A | | 7/1978 | Maus | 175/7 |
| 4,319,635 A | | 3/1982 | Jones | |
| 4,477,237 A | | 10/1984 | Grable | |
| 4,553,903 A | | 11/1985 | Ashikian | |
| 4,860,830 A | | 8/1989 | Jennings, Jr. et al. | |
| 5,048,603 A | | 9/1991 | Bell et al. | |
| 5,048,604 A | | 9/1991 | Vadasz F. et al. | |
| 5,156,537 A | | 10/1992 | Massinon | 417/536 |
| 5,226,482 A | * | 7/1993 | Giannesini et al. | 166/353 |
| 5,295,546 A | * | 3/1994 | Giannesini et al. | 166/353 |
| 5,390,743 A | | 2/1995 | Giannesini | 166/366 |
| 5,415,776 A | | 5/1995 | Homan | 210/519 |
| 5,496,466 A | | 3/1996 | Gray | |
| 5,501,279 A | | 3/1996 | Garg et al. | |
| 5,638,904 A | | 6/1997 | Misselbrook et al. | 166/384 |
| 5,660,532 A | * | 8/1997 | Castel | 417/342 |
| 5,775,442 A | | 7/1998 | Speed | 175/48 |
| 5,857,522 A | | 1/1999 | Bradfield et al. | 166/267 |

(Continued)

FOREIGN PATENT DOCUMENTS

GB 1061743 3/1967

(Continued)

OTHER PUBLICATIONS

PCT International Search Report, International Application No. PCT/US 03/21487, dated Nov. 14, 2003.

(Continued)

*Primary Examiner*—David Bagnell
*Assistant Examiner*—Shane Bomar
(74) *Attorney, Agent, or Firm*—Patterson & Sheridan, LLP

(57) ABSTRACT

The present invention provides apparatus and methods for handling fluids returning from a well. The fluids are introduced into a separator and a separated gas stream is recovered or recycled. The gas stream may comprise more than one phase. The separated gas stream is urged through a multiphase pump before it is recovered. Alternatively, the return fluids may pass through a multiphase pump before it is introduced into the separator.

49 Claims, 4 Drawing Sheets

U.S. PATENT DOCUMENTS

| | | | | |
|---|---|---|---|---|
| 5,992,517 | A | 11/1999 | McAnally | |
| 6,007,306 | A * | 12/1999 | Vilagines | 417/307 |
| 6,032,747 | A * | 3/2000 | Moody et al. | 175/71 |
| 6,035,952 | A | 3/2000 | Bradfield et al. | 175/66 |
| 6,089,322 | A | 7/2000 | Kelley et al. | |
| 6,138,757 | A | 10/2000 | Latos et al. | |
| 6,164,308 | A * | 12/2000 | Butler | 137/2 |
| 6,209,641 | B1 | 4/2001 | Stevenson | |
| 6,216,799 | B1 * | 4/2001 | Gonzalez | 175/5 |
| 6,234,258 | B1 * | 5/2001 | Karigan | 175/66 |
| 6,315,813 | B1 | 11/2001 | Morgan et al. | 95/23 |
| 6,318,464 | B1 | 11/2001 | Mokrys | |
| 6,325,147 | B1 * | 12/2001 | Doerler et al. | 166/252.1 |
| 6,328,118 | B1 * | 12/2001 | Karigan et al. | 175/66 |
| 6,454,542 | B1 | 9/2002 | Back | |
| 6,592,334 | B1 * | 7/2003 | Butler | 417/46 |
| 6,607,607 | B2 | 8/2003 | Walker et al. | |
| 6,629,566 | B2 | 10/2003 | Liknes | |
| 6,668,943 | B1 * | 12/2003 | Maus et al. | 175/5 |
| 2003/0085036 | A1 | 5/2003 | Curtis et al. | 166/267 |
| 2004/0031622 | A1 * | 2/2004 | Butler et al. | 175/5 |
| 2004/0197197 | A1 | 10/2004 | Huttar et al. | |
| 2006/0202122 | A1 * | 9/2006 | Gunn et al. | 250/339.13 |
| 2006/0207795 | A1 * | 9/2006 | Kinder et al. | 175/38 |

FOREIGN PATENT DOCUMENTS

| | | |
|---|---|---|
| GB | 2 215 408 | 9/1989 |
| WO | WO 93/07391 | 4/1993 |
| WO | WO 00/75510 | 12/2000 |
| WO | WO 01/71158 | 9/2001 |
| WO | WO 01/83947 | 11/2001 |
| WO | WO 03/033865 | 4/2003 |

OTHER PUBLICATIONS

D. Hannegan and R. Divine, Underbalanced Drilling—Perceptions and Realities of Today's Technology in Offshore Applications, IADC/SPE 74448, IADC/SPE Drilling Conference, Feb. 26-28, 2002.

J. R. Cameron, C. K. Deem, and W. D. Stearns, The Effect of Drilling Fluid Density and Underbalanced Drilling on Formation Damage Minimization, Amoco Drilling Technology, F95-P-84, Sep. 11, 1995.

* cited by examiner

CLOSED LOOP MULTIPHASE UNDERBALANCED DRILLING PROCESS

BACKGROUND OF THE INVENTION

1. Field of the Invention

Aspects of the present invention generally relate to apparatus and methods for handling wellbore fluids from a well. Specifically, the aspects of the present invention relate to apparatus and methods of recycling wellbore fluids during underbalanced drilling. The aspects of the present invention further relates to apparatus and methods of handling wellbore fluids during well testing.

2. Description of the Related Art

In conventional drilling of wellbores for the production of hydrocarbons, drilling mud is generally used as the circulating medium. The drilling mud is typically made up of a fluid mixture of water and a suitable additive. The drilling mud is injected under pressure through a tubing to the bottom of the wellbore. During operation, the drilling mud at the bottom is continuously circulated to the surface. One of the functions of the drilling fluid is to carry and remove any rock cuttings resulting from the drilling operation to the surface. Another function is to exert a hydrostatic pressure at the bottom of the wellbore to prevent hydrocarbons in the formation from entering the wellbore.

Because the hydrostatic pressure in the wellbore is greater than the formation pressure, the drilling mud will most likely penetrate into or invade the formations surrounding the wellbore. Drilling mud that has penetrated into the formation reduces the permeability of the wellbore, thereby impeding the flow of hydrocarbons into the wellbore. As a result, the productivity of the well can be adversely affected. This type of wellbore damage is generally known as "skin damage" and may extend from a few centimeters to several meters from the wellbore.

More recently, underbalanced drilling was developed to overcome this problem. Underbalanced drilling involves maintaining the equivalent circulating or hydrostatic pressure of the fluid in the wellbore below the formation pressure. This underbalanced condition may be achieved by using a "lightened" drilling fluid as the circulating medium. Examples of lightened drilling fluid include fluids mixed with a gas, such as air, nitrogen, or natural gas. The gas may be introduced at the surface into the drill string for delivery at the bottom of the wellbore. The lightened drilling fluid exerts a hydrostatic pressure at the bottom of the wellbore that is below the formation pressure. In this manner, the underbalanced condition may be maintained.

Drilling fluid returning to the surface typically contains the cuttings from the drilling. Because the underbalanced state may allow a net flow of gas or oil into the wellbore, the return fluid may also contain liquid and gaseous hydrocarbons mixed with the circulating mud when the well penetrates a formation containing hydrocarbons. Therefore, the return fluid reaching the surface may be made up of four phases: solids (cuttings), water, oil, and gas.

The return fluids are typically conveyed into a closed pressure vessel separator. In the separator, the return fluids are separated and delivered into separate streams. In most cases, the separated gas stream is delivered to a flare line or a vent line. When the separated gas stream contains nitrogen or hydrocarbons, valuable resources are unnecessarily wasted or destroyed. Moreover, the separated gas stream is typically disposed in an environmentally unfriendly manner such as flaring.

Therefore, there is a need for a method of recycling the separated gas stream to avoid unnecessary waste. There is also a need for an apparatus for handling multiphase return fluids and recycling the gas stream. There is a further need for an apparatus for handling multiphase return fluids with reduced flaring of the gas stream.

SUMMARY OF THE INVENTION

The present invention generally provides a system for handling fluids returning from a well. The system includes a separator in selective fluid communication with a well outlet and at least one multiphase pump in selective fluid communication with the separator.

In one embodiment, the system has a multiphase pump connected to the separator outlet. The multiphase pump outlet may be connected to the well inlet for recycling at least a portion of the return fluid. Alternatively, the multiphase pump outlet may be connected to an export line for capturing a portion of the return fluid. In another embodiment, the system may have a second multiphase pump disposed between the well outlet and the separator inlet.

In another aspect, the present invention provides a method of treating fluid returning from a well. The method includes introducing the fluid into a separator and introducing at least a portion of the fluid into at least one multiphase pump. In the separator, a gas component of the fluid may be separated from the fluid and may include more than one phase. The separated gas component may be recycled back to the well inlet or delivered to an export line.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
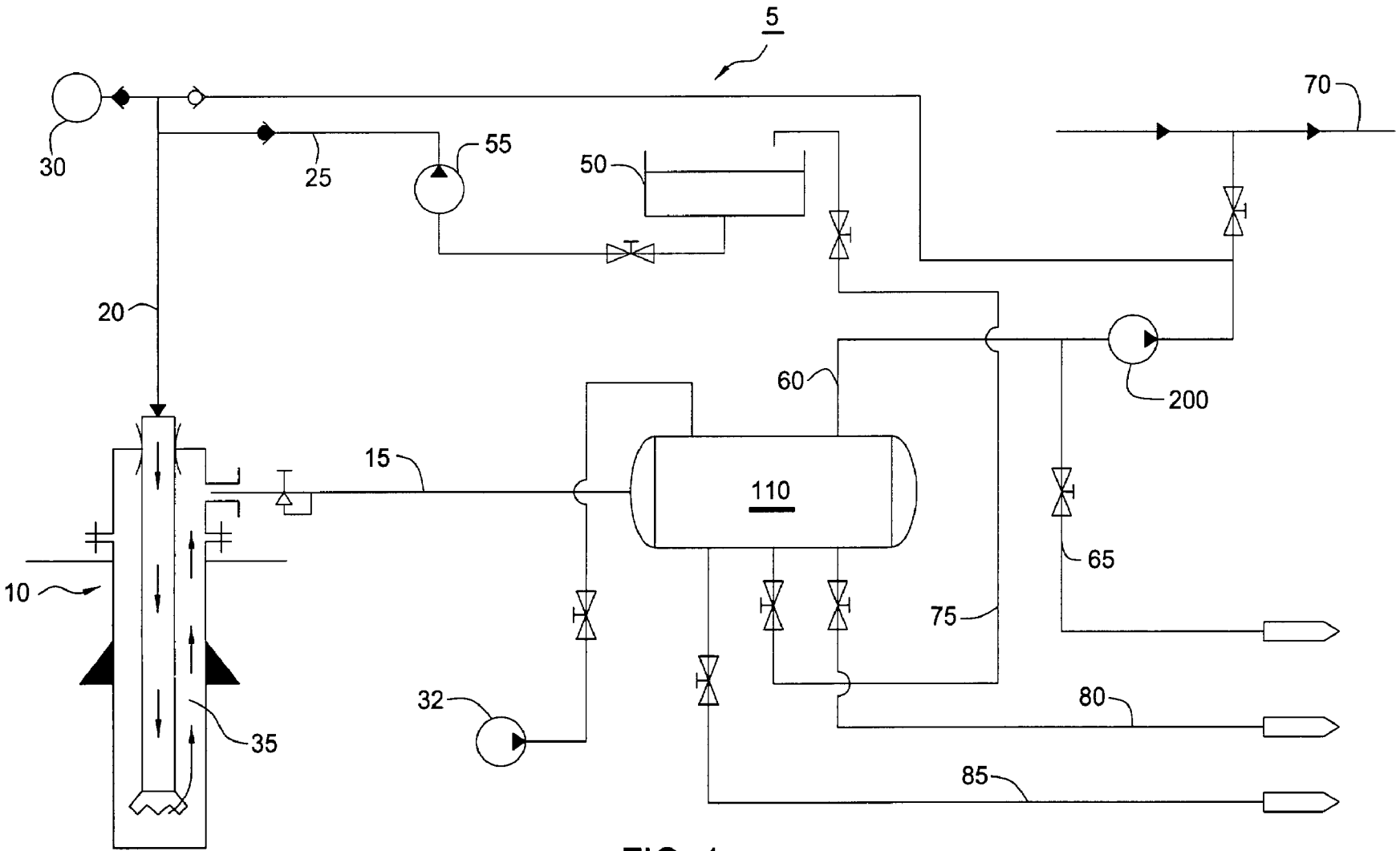
FIG. 1 is a schematic view of one embodiment of a fluid handling circuit according to aspects of the present invention.

FIG. 1 shows a fluid handling circuit 5 for a well 10 undergoing underbalanced drilling according to one embodiment of the present invention. The circuit 5 connects a wellbore outlet 15 to a wellbore inlet 20. A fluid feed line 25 is connected to the well inlet 20 for supplying the liquid portion of the drilling fluid. The drilling fluid is urged down the drill string and out of the drill bit. The wellbore inlet 20 may optionally include a gas supply 30 for providing gas used to lighten the drilling fluid at any desired time during operation, such as In the beginning of the operation, intermittently during operation, or continuously during operation.

Fluid returning from the wellbore annulus 35 ("return fluid") exits the wellbore outlet 15 and is directed to a primary separator 110. The primary separator 110 preferably is a four-phase separator. Four phase separators are known in the art. An exemplary separator suitable for use with the present invention is disclosed in U.S. Pat. No. 5,857,522 issued to Bradfield, et al., which patent is herein incorporated by reference in its entirety. The wellstream is processed in the separator 110 to produced separate streams of solid, oil, liquid, and gas. Although a four phase separator is disclosed herein, other types of separators known to a person of ordinary skill in the art are equally applicable.

Generally, the return fluid entering into the separator 110 passes to a first stage of the separator 110. Solids (sludge), such as drilled cuttings, present in the return fluid are removed in the first stage by gravity forces that are aided by centrifugal action of a device (not shown) disposed in the separator 110. The device is capable of separating the solids from the return fluid and is known in the art. Because solids are heavier than the remaining fluids, the solids collect at the bottom of the separator 110 and are removed therefrom through line 85. The remaining return fluid is substantially free of solids when it passes to a second stage.

The second stage essentially acts as a three phase separator to separate gas, oil, and liquid present in the return fluid into different streams. The separated gas stream varies in composition but usually includes the gas in the drilling fluid and small amounts of entrained fine solids and liquids. Due to its composition, the gas stream is sometimes referred to as wet gas.

According to aspects of the present invention, the wet gas may be recycled and re-used in the drilling operation. As shown in FIG. 1, the wet gas is discharged from the separator 110 through wet gas line 60 which is connected to the well inlet 20. Typically, the wet gas leaving the separator 110 is low in pressure. Therefore, it would be desirable to increase the pressure of the wet gas. However, as discussed above, the wet gas may include three different phases, namely, solid, liquid, and gas.

Figure 2:
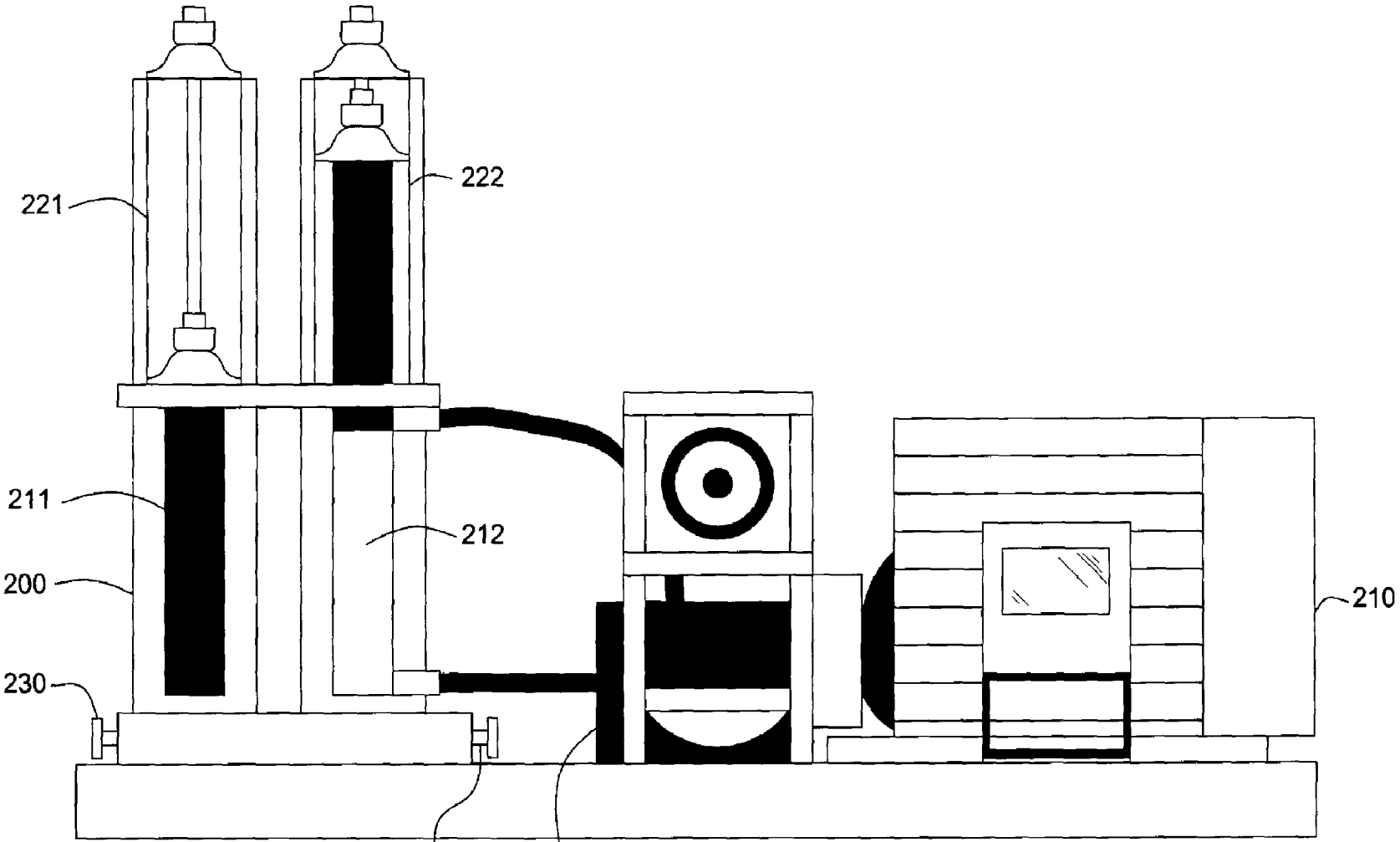
FIG. 2 is a schematic view of an exemplary multiphase pump.

In one embodiment, a multiphase pump 200 may be connected to the wet gas line 60 to boost the pressure of the wet gas. The multiphase pump 200 is designed to handle fluids containing one or more phases, including solids, water, gas, oil, and combinations thereof. FIG. 2 shows an exemplary multiphase pump 200 suitable for use with the present invention. The multiphase pump 200 is a skid mounted multiphase pump having a power unit 210. The multiphase pump 200 has a pair of driving cylinders 211, 212 placed in line with a respective vertically disposed plunger 221, 222. The multiphase pump 200 includes a pressure compensated pump 240 for supplying hydraulic fluid to the pair of cylinders 211, 212 to control the movement of the first and the second plungers 221, 222. The power unit 210 provides energy to the pressure compensated pump 240 to drive the plungers 221, 222.

The plungers 221, 222 are designed to move in alternating cycles. When the first plunger 221 is driven towards its retracted position, a pressure increase is triggered towards the end of the first plunger's 221 movement. This pressure spike causes a shuttle valve (not shown) to shift. In turn, a swash plate (not shown) of the compensated pump 240 is caused to reverse angle, thereby redirecting the hydraulic fluid to the second cylinder 212. As a result, the plunger 222 in the second cylinder 212 is pushed downward to its retracted position. The second cylinder 212 triggers a pressure spike towards the end of its movement, thereby causing the compensating pump 240 to redirect the hydraulic fluid to the first cylinder 211. In this manner, the plungers 221, 222 are caused to move in alternating cycles.

In operation, a suction is created when the first plunger 221 moves toward an extended position. The suction causes the return fluid to enter the multiphase pump 200 through a process inlet 230 and fill a first plunger cavity. At the same time, the second plunger 222 is moving in an opposite direction toward a retracted position. This causes the return fluid in the second plunger cavity to expel through an outlet 235. In this manner, the multiphase return fluid may be effectively moved to a separator 110. Although a pair of cylinders 211, 212 is disclosed, it is contemplated that the aspects of the present invention may be used with one cylinder or any number of cylinders.

Even though the wet gas contains three phases, the multiphase pump 200 may effectively increase the pressure of the wet gas in the wet gas line 60 and recycle the wet gas back to the well inlet 20. In this respect, the fluid handling circuit 5 according to aspects of the present invention may significantly reduce the requirements of separation equipment for recycling the wet gas. Moreover, the multiphase pump 200 will allow recovery or recycling of low pressure gas. In this manner, valuable return fluid gas such as nitrogen and natural gas may be recycled and/or recaptured.

The fluid handling circuit 5 may include a flare line 65 connected to the wet gas line 60. The flare line 65 may be used to discharge excess wet gas in the wet gas line 60. The flare line 65 may direct the excess wet gas to a flare stack or a collecting unit for other manners of disposal.

The oil contained in the return fluid is separated at the second stage. The separated oil collects in a tank (not shown) placed in the second stage of the separator 110. When the oil reaches a predetermined level in the tank, the oil is removed from the separator 110 through line 80. Typically, the oil is disposed in an oil tank for recovery.

Finally, liquid that is substantially free of oil collects in a chamber or reservoir (not shown). Typically, the liquid consists substantially of water. When the liquid reaches a predetermined level, it is discharged to the drilling fluid supply 50 through line 75. In this manner, the liquid may be recycled for use during the drilling operation. The circuit 5 may optionally include a secondary separator (not shown) to separate out any gas remaining in the liquid before delivering it to the drilling fluid supply 50. The separated gas may either be flared or delivered to the wet gas line 60 through a line (not shown) connecting line 75 to line 60. From the drilling fluid supply 50, the liquid may be delivered to the well inlet 20 by a pump 55.

In another embodiment, an export line 70 may be connected to the wet gas line 60. When natural gas is used as the lightening gas or the drilling occurs in a producing formation, the wet gas leaving the separator 110 will contain valuable natural gas. The multiphase pump may be used to increase the wet gas pressure to that of the export line. Thereafter, the wet gas may be captured and realized by directing the gas stream to the export line 70. As a result, the well 10 may start producing for an operator even before the well 10 is completed.

In operation, the return fluid exiting the well outlet 15 enters the separator 110 for separation as shown in FIG. 1. The return fluid is processed in the separator 110 to produce separate streams of solids, liquids, oil, and gas. The solids are removed from the separator 110 through line 85. The oil is removed from the separator 110 through line 80. The liquid is removed from the separator 110 through line 75 and delivered to the drilling fluid supply 50 for recycling. The gas is removed from the separator 110 through line 60. From there, the wet gas enters the multiphase pump 200 where its pressure is increased to facilitate transport through the system 5. Even though the wet gas contains more than one phase, the multiphase pump 200 may effectively increase the pressure of the wet gas. The wet gas leaving the multiphase pump 200 is directed to the well inlet 20 through line 60 and re-used. Alternatively, if the wet gas contains hydrocarbons, the export line 70 may be opened to deliver the hydrocarbons for sale or other use. If excess wet gas exists, the flare line 65 may be opened to direct wet gas to a flare stack for disposal. In this manner, the wet gas in the return fluid may be recycled, collected, or otherwise disposed.

As shown in FIG. 1, the circuit 5 may optionally include a second gas supply 32 connected to the separator 110. The second gas supply 32 may be used as an additional source of gas such as nitrogen. Additionally, the second gas supply may assist with transient fluid flow management common with underbalanced drilling operations.

In another embodiment (not shown), the wet gas leaving the multiphase pump 200 may be directed to a secondary separator. The secondary separator may be used to remove substantially all of the entrained solid and liquid. The separated streams of fluid may then be directed to their respective disposal line. The gas stream leaving the secondary separator will be substantially void of liquid or solid. If desired, another multiphase pump may be used to boost the pressure of the gas stream before it is redirected back to the well inlet 20.

In another embodiment, the export line 70 may alternatively be used as an import line 70. In this respect, the import line 70 may be connected to the wet gas line 60. The import line 70 may be used to supply gas into the wet gas line 60 for introduction into the well 10. In this manner, gas may be added to lighten the drilling fluid from an outside source.

Figure 3:
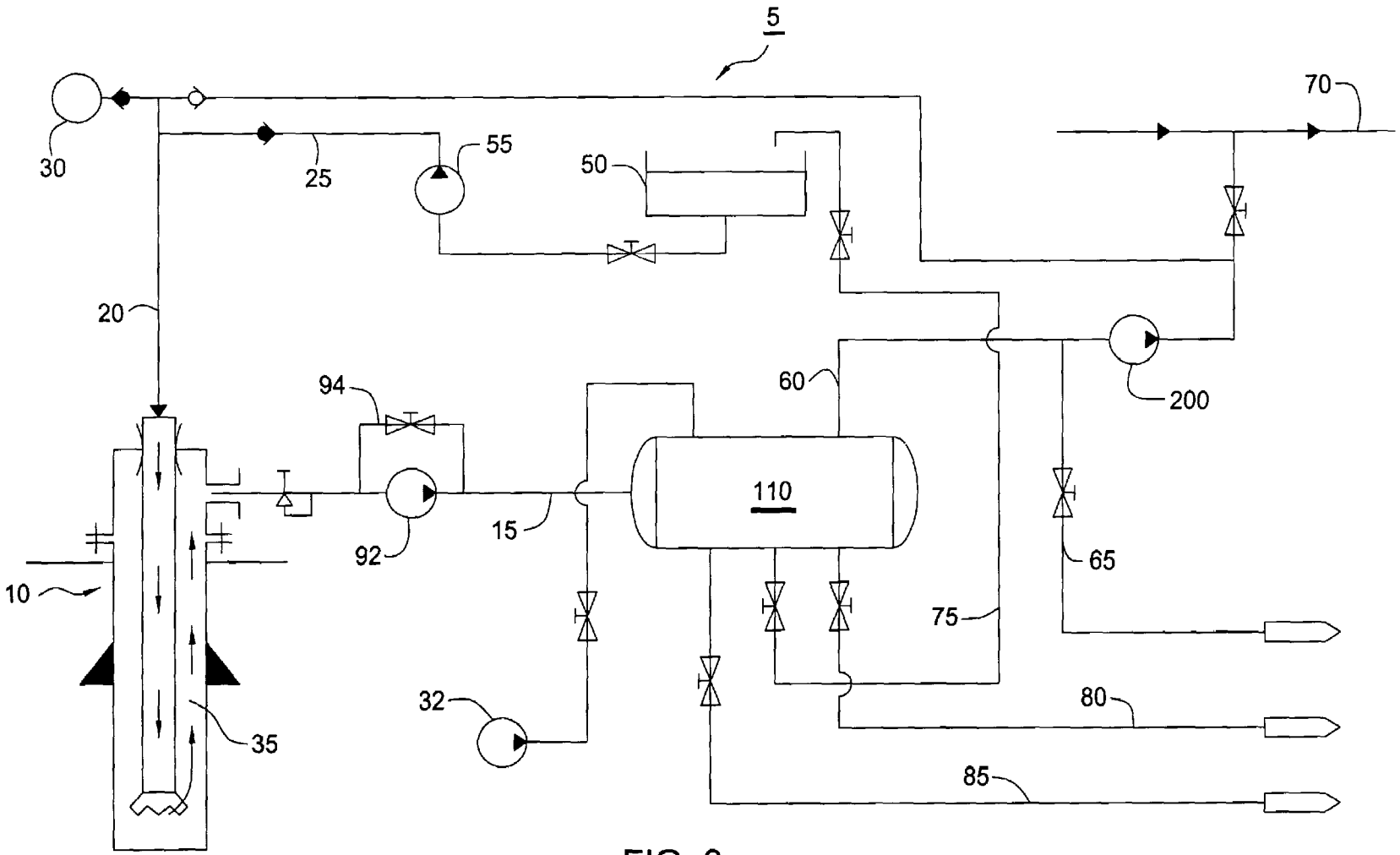
FIG. 3 is a schematic view of another embodiment a fluid handling circuit according to aspects of the present invention.

FIG. 3 illustrates another embodiment according to the aspects of the present invention. In this embodiment, a second multiphase pump 92 is disposed between the well outlet 15 and the separator 110. One advantage of the second multiphase pump 92 is that it may boost the pressure of the return fluid to facilitate recycling thereof. For example, in some wells, the return fluid leaving the well outlet has very low pressure. The first multiphase pump may not be able to increase the wet gas pressure sufficiently for efficient recycling. In such instances, the second multiphase pump may provide the additional boost needed to recycle the return fluid. In another aspect, the fluid handling circuit 5 may include an optional bypass line 94 to circumvent the second multiphase pump 92 when the return fluid is of sufficient pressure. In another aspect still, the second multiphase pump 92 may be used without the multiphase pump 200. In this instance, the second multiphase pump 92 may be designed to increase the pressure of the wellstream sufficiently so as to result in a desired wet gas pressure leaving the separator 110. Consequently, the wet gas may be recycled or exported without the need of multiphase pump 200.

Although the embodiments described above relates to underbalanced drilling, it must be noted that aspects of the present invention are equally applicable to a well not undergoing underbalanced operations. Rather, it is contemplated that aspects of the present invention are generally applicable to the management of wellbore fluids and pressures during wellbore operations without relying on fluid weight to achieve such management.

Figure 4:
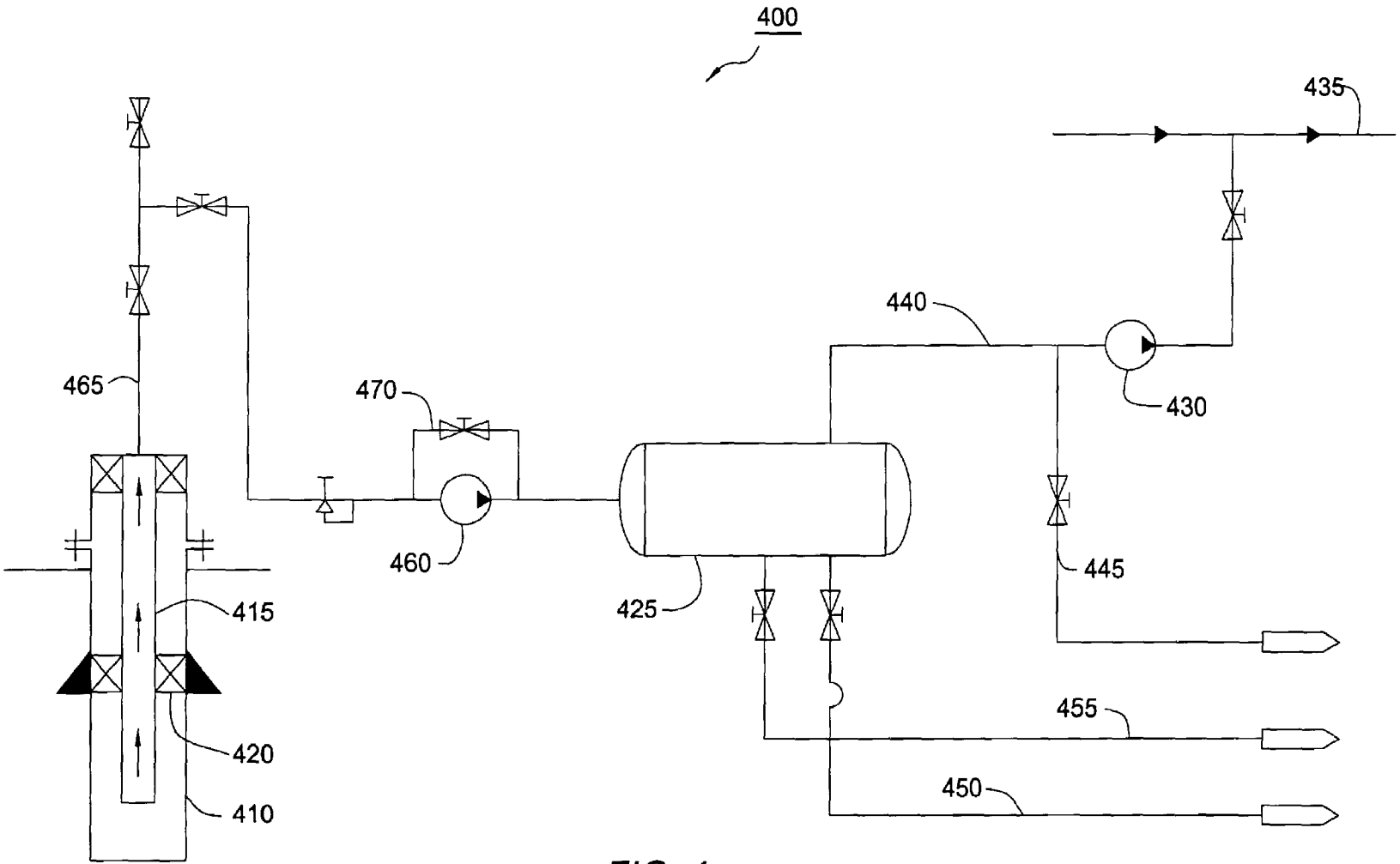
FIG. 4 is a schematic view of one embodiment of a fluid handling system according to aspects of the present invention.

In another aspect, the fluid handling system 400 may be used to handle fluids from a wellbore during well testing. FIG. 4 shows a well 410 having a temporary production testing equipment including a production tubing 415 and at least one packer 420 disposed between the wellbore 410 and the production tubing 415. During testing, the well 410 is permitted to flow hydrocarbon for a period of time so that a quantitative analysis may be performed to determine the hydrocarbon reserves of the well 410. In some instances, the well 410 may be permitted to flow for a period of 10 days before the testing is complete.

During production testing, fluid in the wellbore 410 is allowed to move up the tubing 415, exit the well 410, and enter a separator 425. The fluid is a multiphase fluid because it may contain gas, oil, water, or combinations thereof. In the separator 425, the fluid is separated into different streams of oil, water, and gas. It must be noted that each stream may contain a small amount of various phases. For example, the gas stream may contain small amounts of water and oil, and thus, may appropriately be considered a wet gas stream. The wet gas stream leaving the separator 425 is directed to a multiphase pump 430 where its pressure is increased to a level greater than or equal to the pressure in an export line 435. In this manner, the wet gas stream may be captured during well testing. As a result, the aspects of the present invention provide a method and apparatus to handle fluids from the well 410 during well testing without flaring. However, if desired, the fluid handling system 400 may optionally include a flare line 445 connected to the wet gas line 440. The flare line 445 permits flaring of the wet gas stream and adds versatility to the system 400. The separated oil and water leave the separator 425 through lines 450 and 455, respectively.

As shown in the FIG. 4, the system 400 may optionally include a second multiphase pump 460 disposed between the well outlet 465 and the separator 425. The second multiphase pump 460 may increase the pressure of the return fluids so the wet gas pressure leaving the separator 425 is greater than or equal to the export line pressure. The system 400 may also include a bypass line 470 to circumvent the second multiphase pump 460.

While the foregoing is directed to embodiments of the present invention, other and further embodiments of the invention may be devised without departing from the basic scope thereof, and the scope thereof is determined by the claims that follow.

We claim:

1. A system for handling fluids returning from a well, the well having an inlet and an outlet, comprising:

a separator having an inlet and an outlet, wherein the inlet of the separator is in fluid communication with the well, wherein the separator is adapted to separate a wet gas from the fluids; and at least one multiphase pump in selective fluid communication with the separator, wherein the at least one multiphase pump comprises at least one cylinder having a respective plunger, wherein the at least one multiphase pump is adapted to urge the wet gas down a drill string in the well.

2. The system of claim 1, wherein the at least one multiphase pump comprises a first cylinder and a second cylinder.

3. The system of claim 2, wherein the respective plungers in the first cylinder and the second cylinder move in alternating cycles.

4. The system of claim 1, wherein the wet gas comprises more than one phase.

5. The system of claim 1, wherein the separator is a four phase separator.

6. The system of claim 1, wherein a first multiphase pump is connected to the outlet of the separator.

7. The system of claim 6, wherein a second multiphase pump is disposed between the inlet of the separator and the outlet of the well.

8. The system of claim 6, wherein the wet gas is delivered to the first multiphase pump.

9. The system of claim 8, wherein the wet gas is delivered from the first multiphase pump to the well inlet.

10. The system of claim 8, wherein the wet gas is delivered from the first multiphase pump to an export line.

11. The system of claim 1, wherein the outlet of the separator is in selective fluid communication with the inlet of the well.

12. The system of claim 11, wherein the wet gas is selected from the group consisting of nitrogen, hydrocarbon, and combinations thereof.

13. The system of claim 1, wherein the at least one multiphase pump is disposed between the inlet of the separator and the outlet of the well.

14. The system of claim 1, wherein the well is in an underbalanced state.

15. The system of claim 14, wherein the at least one multiphase pump comprises a first cylinder and a second cylinder, wherein the first cylinder and the second cylinder move in alternating cycles.

16. The system of claim 14, wherein the separator is a four phase separator.

17. The system of claim 14, wherein the wet gas is delivered from the first multiphase pump to the well inlet.

18. The system of claim 14, wherein the wet gas is delivered from the first multiphase pump to an export line.

19. The system of claim 14, wherein the at least one multiphase pump is disposed between the inlet of the separator and the outlet of the well.

20. The system of claim 14, wherein the at least one multiphase pump comprises a first cylinder and a second cylinder.

21. The system of claim 20, wherein the respective plungers in the first cylinder and the second cylinder move in alternating cycles.

22. The system of claim 1, wherein the source of return fluids returns through the wellbore annulus.

23. The system of claim 1, further comprising a gas supply connected to the separator.

24. The system of claim 23, wherein the gas supply is adapted to assist with transient fluid flow management during underbalanced drilling operations.

25. A system for handling fluids returning from a well, the well having an inlet and an outlet, comprising:

a separator having an inlet and an outlet, wherein the inlet of the separator is in fluid communication with the well and the separator is adapted to separate a wet gas from the fluids; and at least one multiphase pump in selective fluid communication with the separator, wherein the wet gas separated from the return fluids is mixed with a drilling fluid and delivered to the inlet of the well.

26. The system of claim 25, wherein the well is in an underbalanced state.

27. The system of claim 25, further comprising a gas supply connected to the separator.

28. The system of claim 27, wherein the gas supply is adapted to assist with transient fluid flow management during underbalanced drilling operations.

29. A system for handling fluids returning from a well, the well having an inlet and an outlet, comprising:

a drill string having drill bit operatively coupled to the inlet of the well;

a separator having an inlet and an outlet, wherein the inlet of the separator is in fluid communication with the outlet of the well and the separator is adapted to separate a wet gas from the fluids; and at least one multiphase pump disposed between the separator and the inlet of the well, wherein the at least one multiphase pump delivers the wet gas from the separator to the inlet of the well.

30. The system of claim 29, wherein the wet gas comprises a gas, a liquid, and a solid.

31. The system of claim 29, wherein a wet gas leaving the at least one multiphase pump is mixed with a drilling fluid.

32. The system of claim 29, further comprising a gas supply connected to the separator.

33. The system of claim 32, wherein the gas supply is adapted to assist with transient fluid flow management during underbalanced drilling operations.

34. A method of handling fluids returning from a well, comprising:

introducing the fluids into a separator;

separating a wet gas from the fluids:

introducing at least a portion of the wet gas into at least one multiphase pump; and delivering the wet gas separated from the fluids to the well; and drilling with the wet gas.

35. The method of claim 34, further comprising mixing the wet gas with a drilling fluid.

36. The method of claim 35, further comprising returning the drilling fluid through an annulus of the well.

37. The method of claim 34, wherein the wet gas has a higher gas content than the fluids returning from the well.

38. The method of claim 34, wherein the wet gas comprises at least two phases.

39. The method of claim 34, further comprising delivering a portion of the wet gas to an export line.

40. The method of claim 34, wherein the at least one multiphase pump comprises at least one cylinder having a respective plunger.

41. The method of claim 40, wherein the at least one multiphase pump comprises a first cylinder and a second cylinder.

42. The method of claim 41, wherein the respective plungers in the first cylinder and the second cylinder move in alternating cycles.

43. The method of claim 34, wherein the at least one multiphase pump comprises a first cylinder and a second cylinder, wherein the first cylinder and the second cylinder move in alternating cycles.

44. The method of claim 34, wherein the well is undergoing underbalanced operations.

45. The method of claim 34, wherein the well is undergoing drilling operations.

46. The method of claim 34, wherein the well is undergoing well testing.

47. The method of claim 34, further comprising recycling a liquid to the well.

48. The method of claim 34, further comprising providing a gas source connected to the separator and supplying a gas to manage fluid flow in the separator during underbalanced drilling operations.

49. The method of claim 48, wherein the gas comprises nitrogen.

* * * * *